US006406001B1

(12) United States Patent
Wada

(10) Patent No.: US 6,406,001 B1
(45) Date of Patent: Jun. 18, 2002

(54) CHAIN LEVER HOIST

(75) Inventor: Yasuo Wada, Osaka (JP)

(73) Assignee: Elephant Chain Block Co., Ltd. (JP)

( * ) Notice: Subject to any disclaimer, the term of this patent is extended or adjusted under 35 U.S.C. 154(b) by 0 days.

(21) Appl. No.: 09/442,947

(22) Filed: Nov. 18, 1999

(30) Foreign Application Priority Data

Dec. 2, 1998 (JP) ..... 10-342462

(51) Int. Cl.[7] ..... B66D 1/14
(52) U.S. Cl. ..... 254/352; 254/369; 254/376
(58) Field of Search ..... 254/342, 352, 254/369, 376

(56) References Cited

U.S. PATENT DOCUMENTS

| | | | | |
|---|---|---|---|---|
| 4,469,308 A | * | 9/1984 | Nakamura et al. | 254/352 |
| 5,088,694 A | * | 2/1992 | Nishimura | 254/352 |
| 5,149,058 A | * | 9/1992 | Nishmura | 254/369 |
| 5,305,989 A | | 4/1994 | Nishi et al. | 254/352 |
| 5,351,937 A | * | 10/1994 | Nishi et al. | 254/352 |
| 5,398,912 A | * | 3/1995 | Nishi et al. | 254/352 |
| 5,575,457 A | * | 11/1996 | Inoue et al. | 254/352 |

FOREIGN PATENT DOCUMENTS

| | | |
|---|---|---|
| JP | 54-9381 | 4/1979 |
| JP | 56-20986 | 7/1979 |
| JP | 59-163298 | 9/1984 |
| JP | 3-85389 | 8/1991 |
| JP | 3-107490 | 11/1991 |
| JP | 9-151084 | 6/1997 |

* cited by examiner

*Primary Examiner*—Emmanuel M. Marcelo
(74) *Attorney, Agent, or Firm*—George T. Marcou; Kilpatrick Stockton LLP

(57) ABSTRACT

For providing a chain lever hoist that can ensure a stable free rotation operation over a long term with a simple design, improvement is made in the chain lever hoist wherein an engaging pawl is switched to a neutral position, at which the engaging pawl is not allowed to engage with engaging teeth in the forward direction or a reverse direction, by the operation of a selector lever and then a load chain on the non-loaded side is pulled or an operating handle is rotated in the reverse direction to thereby produce the free rotation state just the way it is, the improvement being such that the operating lever is rotatably supported on a brake cover at its opening with a predetermined spaced interval from a first hub. By virtue of this, the first hub is allowed to rotate together with the drive shaft, without contacting with the operating lever, during the free rotation operation, and as such can attain reliable free rotation operation.

3 Claims, 8 Drawing Sheets

CHAIN LEVER HOIST

BACKGROUND OF THE INVENTION

1. Field of the Invention

The present invention relates to a chain lever hoist and, more particularly, to a chain lever hoist wherein a load sheave is rotated to wind up and down a load chain passing over the load sheave by the reciprocating operation of an operating lever.

2. Description of the Prior Art

Known as a chain lever hoist of this type is, for example, the one disclosed in Japanese Patent Publication No. 54(1979)-9381 and shown in FIG. 10.

As shown in FIG. 10, in the chain lever hoist, a load sheave 4 over which a load chain 3 passes in engaging relation is supported in rotatable relation between spaced apart first and second side plates 1 and 2 via two bearings 5, 6. The load sheave 4 has a shaft bore in which a drive shaft 7 is inserted in rotatable relation, and a mechanical brake 8 is provided on the drive shaft 7 at the outside of the second side plate 2.

The mechanical brake 8 comprises a second hub 11 connected to the drive shaft 7 in non-rotatable relation relative thereto and having a cylindrical portion 9 and a flange 10, an anti-reverse gear 12 supported on the cylindrical portion 9 of the second hub 11 in freely rotatable relation, two lining plates 13 and 14 supported on the cylindrical portion 9 of the second hub 11 at opposite sides of the anti-reverse gear 12, and an anti-reverse pawl 16 pivoted to a pawl shaft 15 projecting from the second side plate 2 and so biased as to be engaged with the anti-reverse gear 12.

A first hub 17 having engaging teeth 21 around an outside thereof is threadedly mounted on the drive shaft 7 at the axial outside (at the right side as viewed in FIG. 10) of the mechanical brake 8. An operating handle 18 is fitted onto the drive shaft 7 and is fixed to the first hub 17 with screws 19, 20 so as to be non-rotatable relative thereto at the axial outside of the first hub 17. Further, a coil spring 28 for biasing the first hub 17 and the second hub 11 to be forced away from each other is interposed between the first hub 17 and the second hub 11.

A lock nut 30 is fixed to the drive shaft 7 by a set pin at an end of the drive shaft 7 on the side thereof on which the operating handle 18 is fitted, with a predetermined spaced interval from the operating handle 18, so as to be axially immovable, and thereby the range of axial movement of the first hub 17 movable together with the operating handle 18 is limited. On the other hand, a reduction gear mechanism 24 is provided at the other axial end of the drive shaft 7, to transmit the drive applied from the drive shaft 7 to the load sheave 4 at a predetermined reduction ratio.

A gear cover 25 for covering the reduction gear mechanism 24 is fixed to the first side plate 1, and a brake cover 26 for covering the mechanical brake 8, formed having an opening 29 for the first hub 17 to be fitted in, is fixed to the second side plate 2. An operating lever 22 is loosely fitted around the outside of the first hub 17 at the axial outside of the brake cover 26. The operating lever 22 is provided with an engaging pawl 23 which can be selectively switched to a normal position at which only a normal rotation drive of the operating lever 22 is transmitted, a reverse position at which only a reverse rotation drive of the operating lever is transmitted, and a neutral position at which the engaging pawl 23 and the engaging teeth 21 are not engaged with each other, to disengageably engage with engaging teeth 21 of the first hub 17.

When a load is hoisted up by use of the chain lever hoist thus constructed, the engaging pawl 23 of the operating lever 22 is first switched to the normal position by the operation of a selector lever 27 to be brought into engagement with the engaging teeth 21 of the first hub 17 and, then, the operating lever 22 is reciprocated to screw the first hub 17 forward so as to press the mechanical brake 8, whereby the load sheave 4 is allowed to rotate in the normal rotation direction through the drive shaft 7 and the reduction gear mechanism 24. On the other hand, when the load is lowered down, the engaging pawl 23 of the operating lever 22 is first switched to the reverse position by the operation of the selector lever 27 to be brought into engagement with the engaging teeth 21 of the first hub 17 and, then, the operating lever 22 is reciprocated to screw the first hub 17 backward, so as to release the mechanical brake 8, whereby the load sheave 4 is allowed to rotate in the reverse rotation direction under the weight of the load to permit the lowering of the load. Along with the lowering of the load, the drive shaft 7 is reversed, so that the first hub 17 is screwed forward again to put the mechanical brake 8 into action. By repetition of this action and release of the mechanical brake 8, the load can be gradually lowered down.

Further, when the load chain 3 is desired to be adjusted in length at the start of working, for example, the engaging pawl 23 of the operating lever 22 is switched to the neutral position by the operation of the selector lever 27, not to be brought into engagement with the engaging teeth 21. Then, the pressing of the first hub 17 against the mechanical brake 8 is released by a spring force of the coil spring 28 and, as a result of this, the first hub 17 comes to be rotatable together with the drive shaft 7 to thereby produce the free rotation condition. If a load is suspended from the load chain 3 on the loaded side, a large thrust from the weight of the load is applied to the drive shaft 7, so that even if the engaging pawl 23 is switched to the neutral position, since the first hub 17 presses the mechanical brake 8 against the spring force of the coil spring 28, the free rotation state will not be produced.

However, when the free rotation operation of the chain lever hoist thus constructed is carried out, since the first hub 17 and the operating handle 18 are in contact with the operating lever 22, the contact resistance can hinder smooth rotation of the first hub 17 to cause the first hub 17 to rotate relative to the drive shaft 7 and, as a result of this, there may be produced a possible problem that the first hub 17 may press the mechanical brake 8 to put the mechanical brake 8 into action.

On the other hand, it may be practical to allow for the contact resistance between the first hub 17 and the operating handle 18 and the operating lever 22 and use the coil spring 28 having a spring force sufficient for the first hub 17 to rotate against the contact resistance. However, it is hard to pre-select the coil spring 28 having the right spring force corresponding to the contact resistance. Besides, since the contact resistance varies depending on the degree of abrasion or wear of the contacting parts, the rotation of the first hub 17 varies depending on the degree of the abrasion or wear. Further, the chain lever hoist is used in various conditions, such as the condition in which the chain lever hoist is suspended from overhead and the operating lever is in vertical orientation, the condition in which the chain lever hoist is suspended from overhead and the operating lever is in somewhat tilt with respect to the vertical direction, or the condition in which the chain lever hoist is not suspended from overhead and is put in horizontal orientation. Depending on the use condition of the chain lever hoist, variation is caused in the application of the weight of the first hub 17, the operating handle 18 and the operating lever 22, which in turn causes variation in the contact resistance in each use condition. Because of this, the ability for the first hub 17 to be rotated relative to the drive shaft 7, in other words, the ability for the mechanical brake 8 to be engaged in the free rotation state, is varied and, therefore, there is the disadvantage that a stable free-rotation operation cannot be attained.

SUMMARY OF THE INVENTION

It is the object of the present invention is to provide a chain lever hoist that can attain a stable free-rotation operation for a long term with simple design.

The present invention provides a chain lever hoist comprising a load sheave with which a load chain is engaged; a first hub forming engaging teeth around an outside thereof; an operating lever having an engaging pawl detachably engageable with the engaging teeth and loosely fitted around the outside of the first hub; a mechanical brake comprising a second hub interposed between the first hub and the load sheave, an anti-reverse gear supported on the second hub, two brake disks supported on the second hub at the opposite sides of the anti-reverse gear, and an anti-reverse pawl disposed at the outside of the anti-reverse gear and engageable with the anti-reverse gear; a drive shaft, on which the first hub is threadedly mounted and with which the second hub is connected in non-rotatable relation relative thereto and onto which the load sheave is fitted, for allowing drive applied from the operating lever to be transmitted to the load sheave through a reduction gear mechanism; a biasing means, interposed between the first hub and the second hub, for biasing the first hub and the second hub to be away from each other, the biasing means having a biasing force of such an extent that can keep the mechanical brake in its released state during free rotation operation and also put the mechanical brake into action in the free rotation operation when a rotation drive exceeding contact resistance between the drive shaft and the first hub is applied to the drive shaft; and a brake cover for covering the mechanical brake, the brake over being formed having an opening for the first hub to be inserted in, wherein when engagement between the engaging pawl and the engaging teeth is released in the state in which no load is applied to the load chain on a loaded side thereof, pressing of the first hub against the mechanical brake can be released by the biasing force of the biasing means to put the first hub and the drive shaft into a rotatable-together state to thereby produce free rotation condition and wherein the operating lever is rotatably supported on the brake cover at the opening thereof with a predetermined spaced interval from the first hub.

In this arrangement, the operating lever is rotatably supported on the brake cover at the opening thereof with a predetermined spaced interval from the first hub. Thus, the first hub is rotated together with the drive shaft without contacting with the operating lever, thus ensuring smooth and reliable rotation of the first hub. By virtue of this, the condition for the relative rotation of the first hub to the drive shaft to be caused, in other words, the condition for the mechanical brake to be put in action in the free rotation state, can be determined by only the biasing force of the biasing means. Thus, it is good enough for attainment of the reliable free rotation operation to adopt the biasing means having a biasing force of such an extent that can put the mechanical brake into action when the rotation drive exceeding the contact resistance between the drive shaft and the first hub is applied to the drive shaft in the free rotation state. Thus, the stable free rotation operation can be ensured for a long term with the simple design.

According to the present invention, it is preferable that the chain lever hoist further comprises an operating member fitted onto the drive shaft and mounted on the first hub in non-rotatable relation relative thereto and that a cylindrical insertion portion for inserting therein the operating member is formed in the operating lever, with a predetermined spaced interval from the operating member.

In this arrangement, the pressing of the first hub against the mechanical brake can be released simply by rotating the operating member in the reverse direction for the free rotation operation, and as such can facilitate the free rotation operation. Also, since the operating member is mounted on the first hub with a predetermined spaced interval from the cylindrical insertion portion of the operating lever, the operating member can be prevented from contacting with the operating lever during the free rotation operation, and as such can ensure the smooth and reliable rotation.

According to the present invention, it is preferable that the brake cover has a brake-cover-side connecting portion for connecting the brake cover with the operating lever, while on the other hand, the operating lever has a lever-side connecting portion for connecting the operating lever with the brake cover, that the brake-cover-side connecting portion and the lever-side connecting portion are connected together by connecting means, and that the connecting means is arranged with a predetermined spaced interval from the first hub.

In this arrangement, since the operating lever and the brake cover are connected with each other by the connecting means arranged with a predetermined spaced interval from the first hub, the axial movement of the operating lever and the brake cover are limited, while also improved strength of the connecting portion thereof can be attained. By virtue of this, the operating lever can be kept from contacting the first hub and the operating member due to a tilted orientation of the operating lever resulting from the reciprocating motion of the operating lever, for example. Thus, a further stable free rotation operation can be attained.

According to the present invention, it is preferable that the connecting means comprises a holding member for holding the brake-cover-side connecting portion and the lever-side connecting portion in sandwich relation and a retaining member which is held in sandwich relation together with the brake-cover-side connecting portion and the lever-side connecting portion.

In this arrangement, the retaining member is fitted in the holding member and also the lever-side connecting portion and the brake-cover-side connecting portion are fitted by the retaining member, whereby the operating lever can be rotatably supported on the brake cover.

By virtue of this, for example the mount of the operating lever on the brake cover can readily and surely be attained by the use of the holding member arranged in advance, without taking such a step that after the brake-cover-side connecting portion and the lever-side connecting portion are held in sandwich relation by the holding member, the holding member is crimped.

According to the present invention, it is preferable that the drive shaft has a screw-thread portion, for the first hub and the second hub to be both threadedly mounted on, which is formed being substantially equal in diameter, and a fitting groove formed in the screw-thread portion at a certain point thereof, whereby the first hub and the second hub are threadedly mounted on the screw-thread portion and also a limiting means is fitted in the fitting groove so that an axial movement of the second hub can be limited.

In this arrangement, since the screw-thread portion on which the first hub and the second hub are both threadedly mounted is formed being substantially equal in diameter, rigidity of the drive shaft can be increased and thus durability of the chain lever hoist can be increased. For example in a case where the drive shaft is splined at a portion thereof for mounting the second hub thereon and is threaded at a portion thereof for mounting the first hub thereon, the drive shaft will inevitably be reduced in rigidity and durability. This is because since the second hub must be mounted first prior to the mounting of the first hub in the assembling work, the threaded portion of the drive shaft cannot help being made smaller in diameter than the splined portion and also a portion of the drive shaft extending between the splined portion and the threaded portion cannot help being made smaller in diameter than those portions for the machining need. The arrangement of the invention in which the first hub and the second hub are threadedly mounted on the screw-thread portion of substantially equal in diameter and also the limiting means is fitted in the fitting groove, whereby the first hub can be screwed forward and backward along the drive shaft and also the second hub can be non-rotatable relative to the drive shaft can provide increased rigidity of the drive shaft and thus improved durability of the chain lever hoist.

BRIEF DESCRIPTION OF THE DRAWINGS

The present invention will now be described with reference to the accompanying drawings wherein.

DETAILED DESCRIPTION OF THE PREFERRED EMBODIMENT

Referring now to the accompanying drawing figures, an example of the preferred embodiment of the invention is described below.

Figure 1:
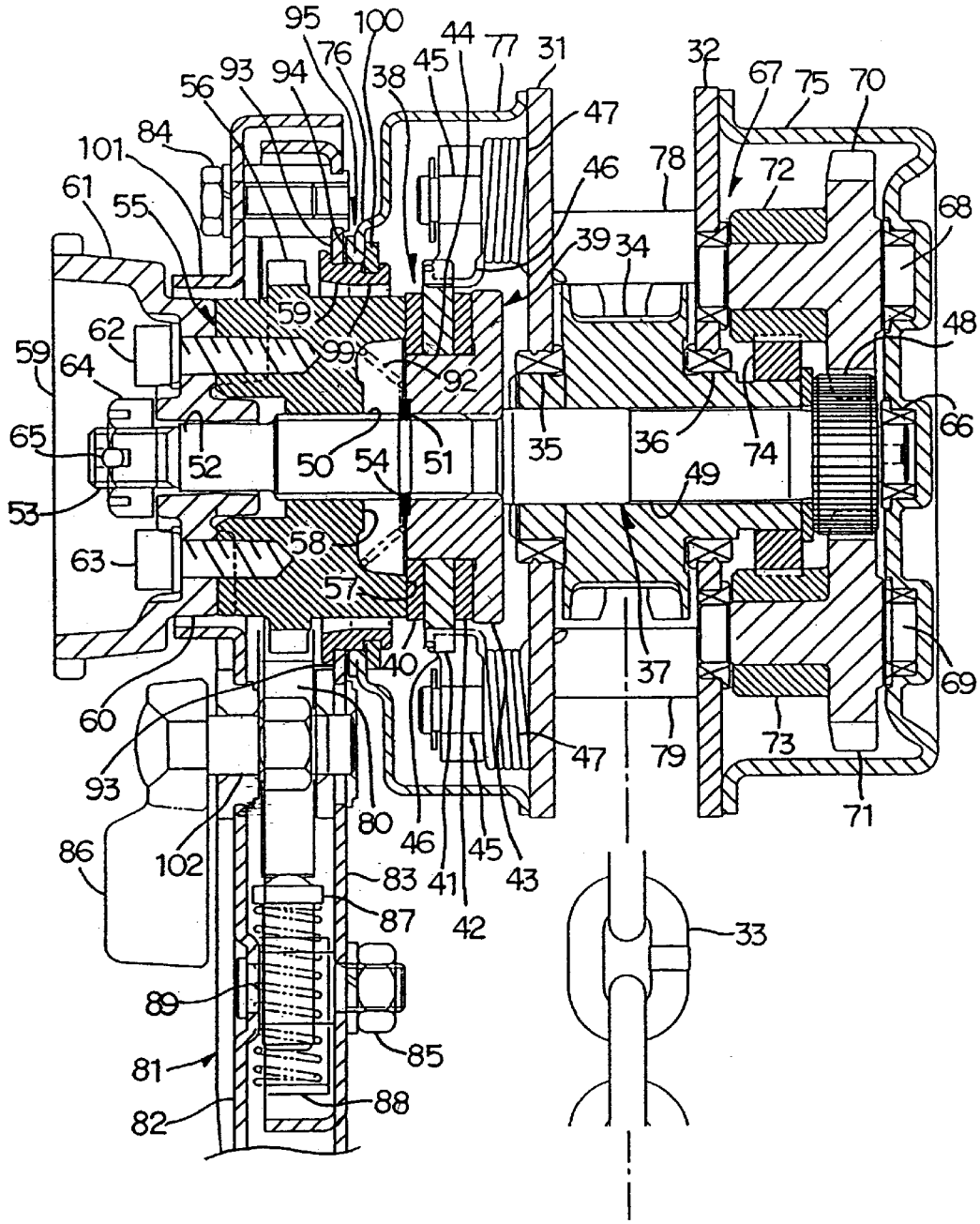
FIG. 1 is a longitudinal sectional view showing a chain lever hoist as one embodied form of the present invention.

Referring to FIG. 1, there is shown a longitudinal sectional view showing a chain lever hoist as one embodied form of the present invention. In the chain lever hoist, a load sheave 34 over which a load chain 33 passes in engaging relation is supported in rotatable relation between spaced apart first and second side plates 31 and 32 via two bearings 35, 36. The first side plate 31 and the second side plate 32 are fixed together with a gear cover 75 and a brake cover 77, as mentioned later, through a pair of upper stay bolts 78 and a pair of lower stay bolts 79 (only one of each pair of stay bolts are presented in FIG. 1).

Figure 3:
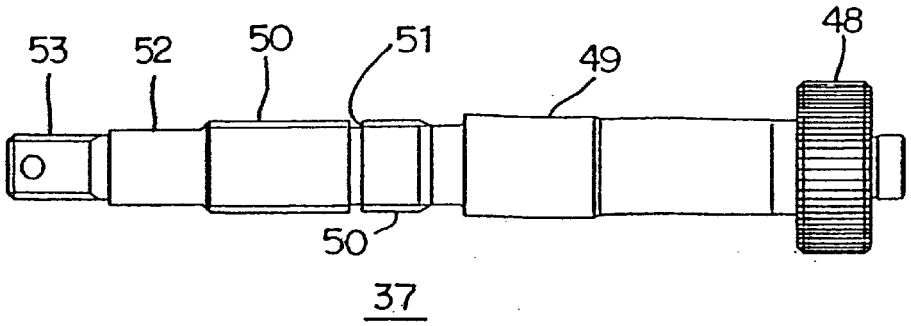
FIG. 3 is a side view showing the drive shaft of the chain lever hoist shown in FIG. 1.

The load sheave 34 has a shaft bore in which a drive shaft 37 is inserted in rotatable relation. As shown in FIG. 3 as well, the drive shaft 37 has a first gear 48 formed at one axial end portion of the drive shaft, a load sheave fitting portion 49 for fitting the load sheave 34 to it, a screw-thread portion 50 of substantially equal in diameter, a fitting groove 51 formed in the screw-thread portion 50 at a certain point thereof, an operating handle fitting portion 52, formed smaller in diameter than the screw-thread portion 50, for fitting an operating handle 59 thereto, and a lock nut screwing portion 53, formed at the other end portion of the drive shaft, for threadedly mounting thereon a lock nut mentioned later.

A mechanical brake 38 is provided at the axially outside of the load sheave 34 (at the left side of FIG. 1) and at the outside of the first side plate 31. The mechanical brake 38 is provided with a second hub 39 connected to the drive shaft 37 in non-rotatable relation relative thereto. The second hub 39 is threadedly mounted on the screw-thread portion 50 of the drive shaft 37 and its axial movement is limited by a stop member 54 of a limiting means being fitted in the fitting groove 51. The second hub is formed in one piece having a flange 43 and a cylindrical portion 44 extending axially outwardly from the flange 43. The first lining plate 40 forming a brake disk, an anti-reverse gear 41 and a second lining plate 42 forming a brake disk are supported on the cylindrical portion 44 of the second hub 39 in freely rotatable relation in the order presented from the axial outside.

Two pawl shafts 45 are provided on the first side plate 31 at opposed positions. Anti-reverse pawls 46 engageable with the anti-reverse gear 41 are pivoted on the two pawl shafts 45 in swingable relation, respectively. Further, pawl springs 47 for biasing the anti-reverse pawls 46 toward the anti-reverse gears 41 are provided on the two pawl shafts 45 between the anti-reverse pawls 46 and the first side plate 31, respectively. The mechanical brake 38 is composed of the second hub 39, the anti-reverse gear 41, the first lining plate 40, the second lining plate 42 and the anti-reverse pawl 46.

A first hub 55 is screwably mounted on the screw-thread portion 50 of the drive shaft 37 at the axial outside of the mechanical brake 38. The first hub 55 is of cylindrical configuration and has engaging teeth 56 formed around the outside thereof, a spring receiving portion 58 formed in recessed configuration at an end thereof on the axially inward side (at the right side of FIG. 1) and a pressing portion 57, formed around the outside of the spring receiving portion, for pressing the first lining plate 40 of the mechanical brake 38.

Figure 4:
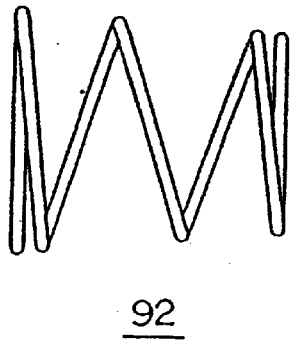
FIG. 4 is a side view showing a coil spring of the chain lever hoist shown in FIG. 1.

A coil spring 92 forming a biasing means is interposed between the spring receiving portion 58 of the first hub 55 and the second hub 39. The coil spring 92 is composed of a compression spring, as shown in FIG. 4, biasing the first hub 55 and the second hub 39 to be forced away from each other, so that the release of the mechanical brake 38 can be held during the free-rotation operation. The coil spring 92 used has a spring force of such an extent that can put the mechanical brake 38 into action or can allow the first hub 55 to be screwed forward when a rotational drive in excess of the contact resistance between the drive shaft and the first hub 55 is applied to the drive shaft 37 in the free rotation state.

Further, an operating handle 59 forming an operating member is fitted onto the operating handle fitting portion 52 of the drive shaft 37 at the axial outside of the first hub 55. The operating handle 59 is composed of a base 60 and a cylindrical grip 61 continuously projecting from around the outside of the base 60. The base 60 is fixed to the first hub 55 by two screws 62, 63 in non-rotatable relation relative to the first hub.

A lock nut 64 is threadedly mounted on the drive shaft 37 at an end thereof at the axial outside of the operating handle 59, with a predetermined spaced interval from the operating handle 59 fitted onto the drive shaft 37. The lock nut 64 is fixed to the drive shaft 37 at the end portion thereof by a set pin 65, so as to be axially immovable, and thereby the range of axial movement of the first hub 55 moving together with the operating handle 59 is limited.

On the other hand, the drive shaft 37 is supported at the other axial end thereof by a bearing 66, and a reduction gear mechanism 67 having a plurality of reduction gears, which forms the gear transmission mechanism, is provided between the bearing 66 and the load sheave 34 at the outside of the second side plate 32. The reduction gear mechanism 67 is composed of a first gear 48 formed on the drive shaft 37 at an end thereof, second gears 70 and 71 engaged with the first gear 48 and formed on a pair of intermediate shafts 68 and 69, respectively, third gears 72 and 73 formed on the pair of intermediate shafts 68 and 69, respectively, as in the second gears, and a fourth gear 74 connected with an extended part of the load sheave 34 and engaged with the third gears 72 and 73. The drive applied from the drive shaft 37 is transmitted from the first gear 48 to the second gears 70, 71 engaged with the first gear and in turn is transmitted from the intermediate shafts 68, 69 supporting thereon the second gears 70, 71 to the fourth gear 74 through the third gears 72, 73 supported on the intermediate shafts 68, 69. Thus, the drive applied from the drive shaft 37 is transmitted to the load sheave 34 at a predetermined reduction ratio.

A gear cover 75 for covering the reduction gear mechanism 67 is mounted on the second side plate 32. The pair of intermediate shafts 68, 69 are rotatably supported between the second side plate 32 and the gear cover 75 at side ends thereof via bearings.

Figure 7:
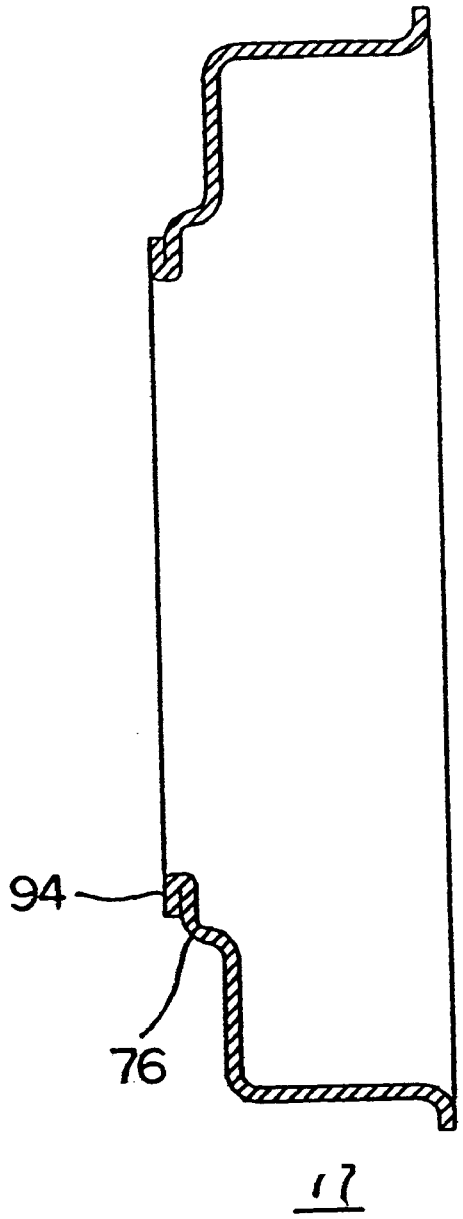
FIG. 7 is a side view in section showing a brake cover of the chain lever hoist shown in FIG. 1.

On the other hand, a brake cover 77 for covering the mechanical brake 38, which forms therein an opening 76 for the first hub 55 to be inserted in, is mounted on the first side plate 31, as shown in FIG. 7. The first hub 55 is threadedly mounted on the screw-thread portion 50 of the drive shaft 37 in such a state as to be inserted from the opening 76 of the brake cover 77 into the axially inside thereof.

In the illustrated embodiment, an operating lever 81 is loosely fitted around the outside of the first hub 55 and is rotatably supported at the opening 76 of the brake cover 77, with a predetermined spaced interval from the first hub 55.

The operating lever 81 is formed by opposed first and second covers 82, 83 being put together with a plurality of bolts (only two bolts 84, 85 are presented in FIG. 1). An engaging pawl 80 detachably engageable with the engaging teeth 56 of the first hub 55 is swingably fitted in between the first cover 82 and the second cover 83 by a pivot 102 having a selector lever 86 at the head. A presser 87 for pressing the engaging pawl 80 toward the engaging teeth 56, a receiving member 88 receiving therein the presser 87, and a spring 89, interposed between the presser 87 and the receiving member 88, for biasing the presser 87 toward the engaging pawl 80, are provided between the first cover 82 and the second cover 83.

Figure 2:
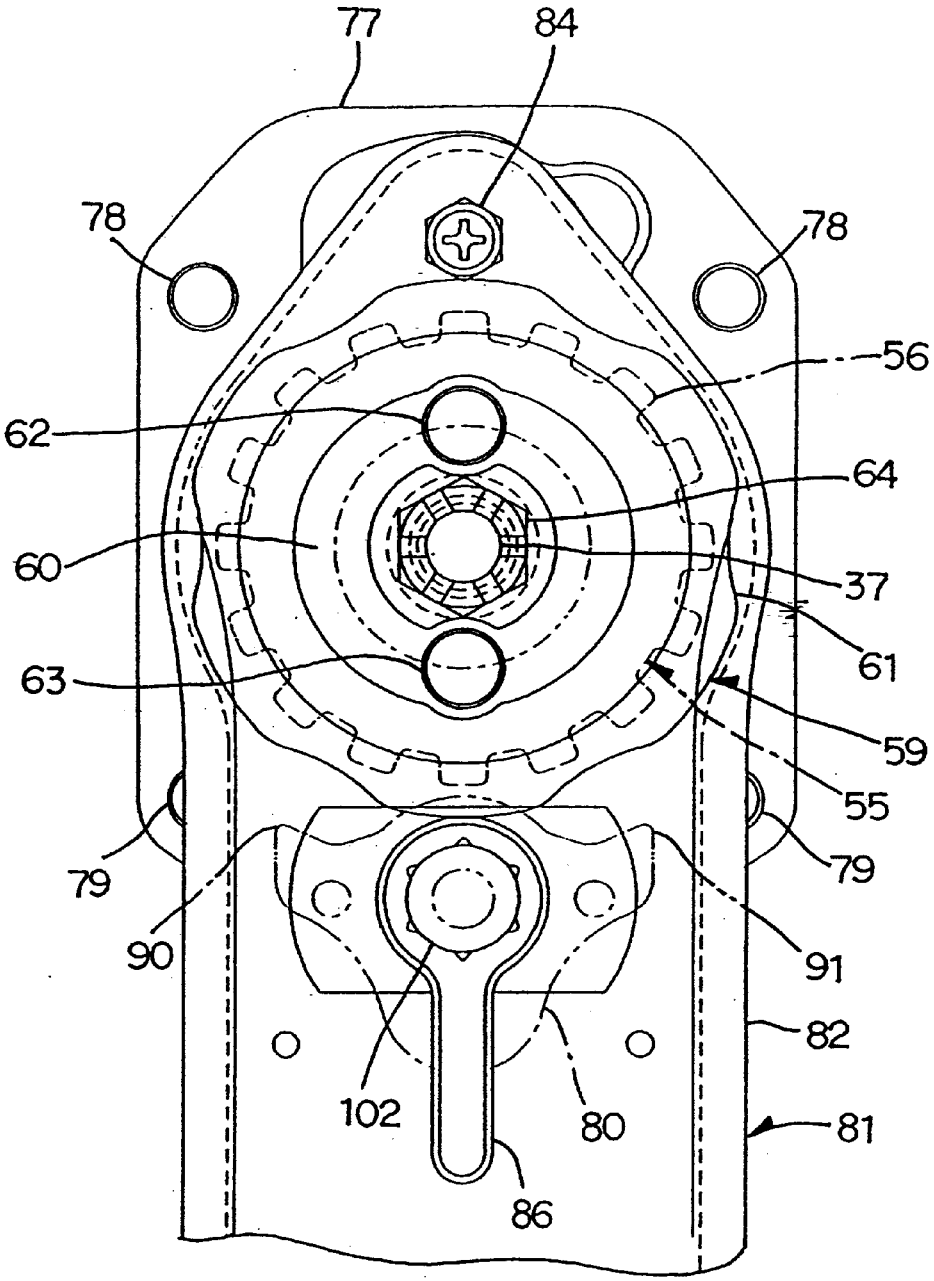
FIG. 2 is a front view of a principal part of the chain lever hoist shown in FIG. 1.

As shown in FIG. 2, the engaging pawl 80 is provided with a forward engaging projection 90 which is engaged with the engaging teeth 56 to transmit the drive from the operating lever 81 to the first hub 55 only when the first hub 55 is rotated in the normal rotation direction (or is rotated in the hoisting direction) and a backward engaging projection 91 which is engaged with the engaging teeth 56 to transmit the drive from the operating lever 81 to the first hub 55 only when the first hub 55 is rotated in the reverse rotation direction (or is rotated in the lowering direction). The engaging pawl 80 is selectively switched to one of a normal position at which the forward engaging projection 90 is engaged with the engaging teeth 56 of the first hub 55 to permit the transmission of only the normal rotation drive of the operating lever 81, a reverse position at which the backward engaging projection 91 is engaged with the engaging teeth to permit the transmission of only the reverse rotation drive, and a neutral position at which the engaging pawl 80 is not engaged with the engaging teeth 56.

Figure 6:
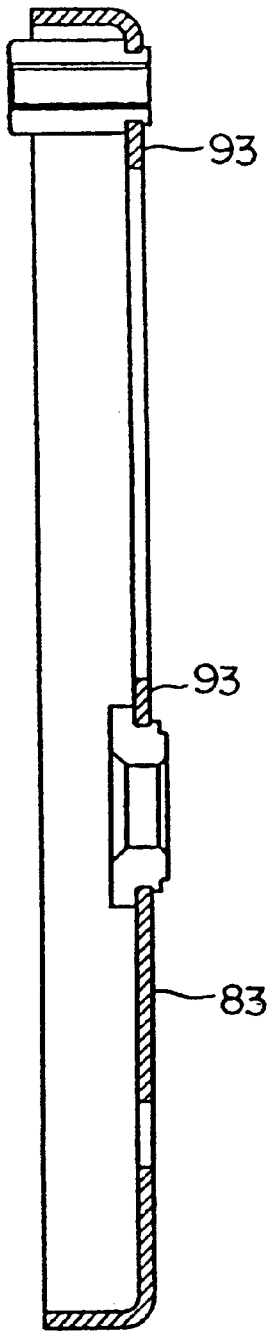
FIG. 6 is a side view in section showing a second cover of the operating lever of the chain lever hoist shown in FIG. 1.

In the second cover 83 is formed an aperture for loosely fitting the first hub 55 in it, as shown in FIG. 6. A marginal portion around the aperture of the second cover 83 forms a lever-side connecting portion 93 for connecting the operating lever with the brake cover 77. On the other hand, a marginal portion around the opening 76 of the brake cover 77 forms a brake-cover-side connecting portion 94 for connecting the brake cover with the operating lever 81. The lever-side connecting portion 93 and the brake-cover-side connecting portion 94 are connected with each other by connecting means 95 spaced apart from the first hub 55 with a predetermined interval.

Figure 8:
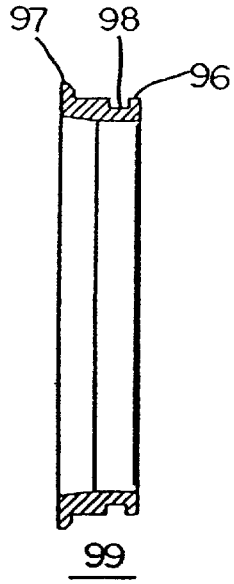
FIG. 8 is a side view in section showing a holding member of the chain lever hoist shown in FIG. 1.
Figure 9:
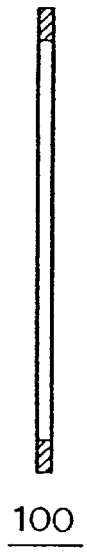
FIG. 9 is a side view in section showing a retaining member of the chain lever hoist shown in FIG. 1.
Figure 10:
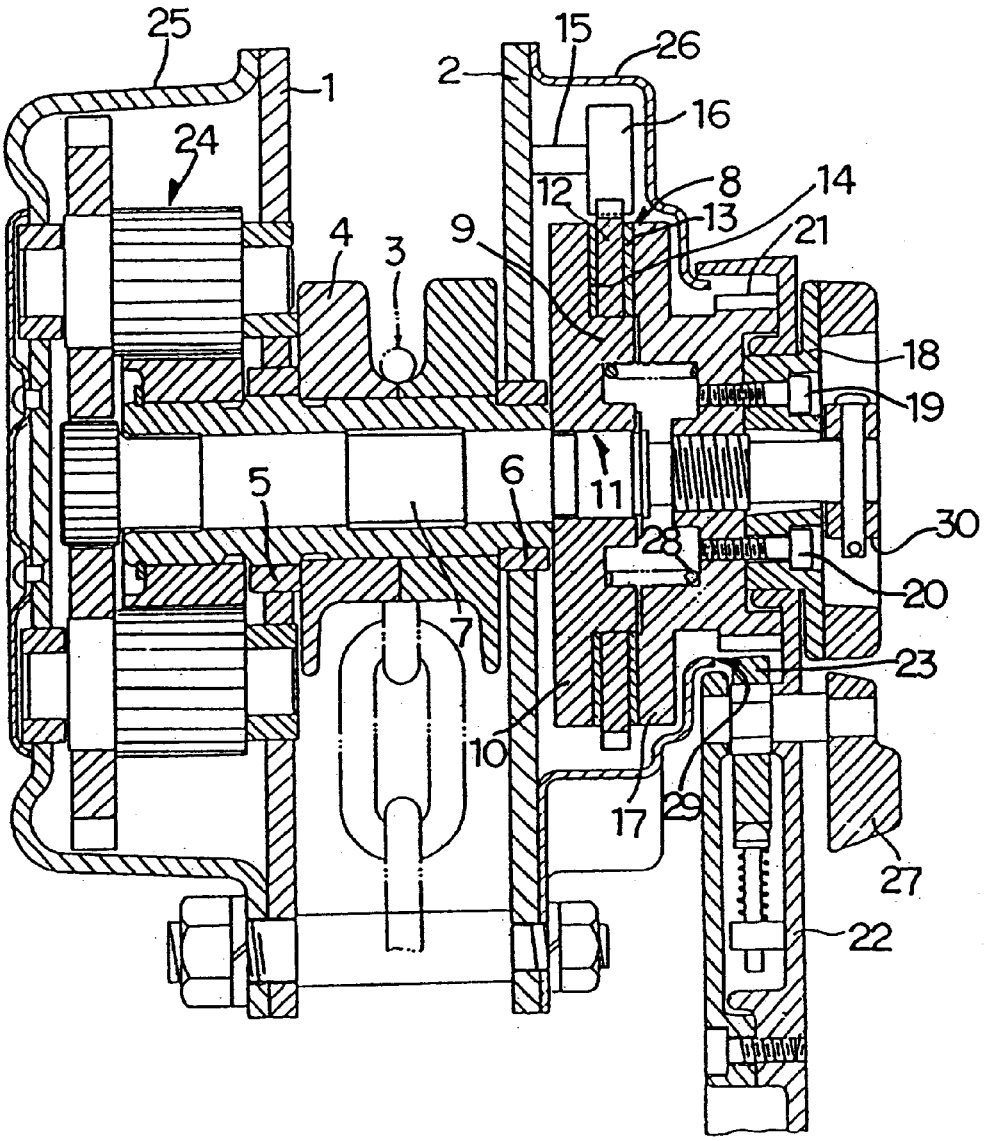
Prior Art Fig. 10
FIG. 10 is a side view in section showing a conventional type of chain lever hoist.

In more detail, the connecting means 95 includes a cylindrical holding member 99 having flanges 96, 97 at opposite ends thereof and a recessed portion 98 formed at a location adjoining the flange 96, as shown in FIG. 8, and a ring-shaped retaining member 100 held in sandwich relation, together with the lever-side connecting portion 93 and the brake-cover-side connecting portion 94, as shown in FIG. 9. The retaining member 100 is fitted in the recessed portion 98 of the holding member 99, and the lever-side connecting portion 93 and the brake-cover-side connecting portion 94 are fitted in between both flanges 96, 97 in overlapping relation with each other, whereby the axial movement of the operating lever 81 and the brake cover 77 are limited and also the operating lever 81 is rotatably supported on the brake cover 77, while the strength of the connecting portion is intended to be increased. This can prevent the tilt of the operating lever 81 resulting from the reciprocating motion of the operating lever 81, and as such can allow the operating lever 81 to be well kept from contacting with the first hub 55 and the operating handle 59. Thus, the stable free rotation operation can be attained over a long term. Also, the use of the retaining member 100 in combination with the holding member 99 as the connecting means 95 can yield simple and reliable mount of the operating lever 81 on the brake cover 77 by the use of the holding member 99 arranged in advance, without taking such a step that after the brake-cover-side connecting portion 94 and the lever-side connecting portion 93 are held in sandwich relation by the holding member 99, the holding member 99 is crimped.

Figure 5:
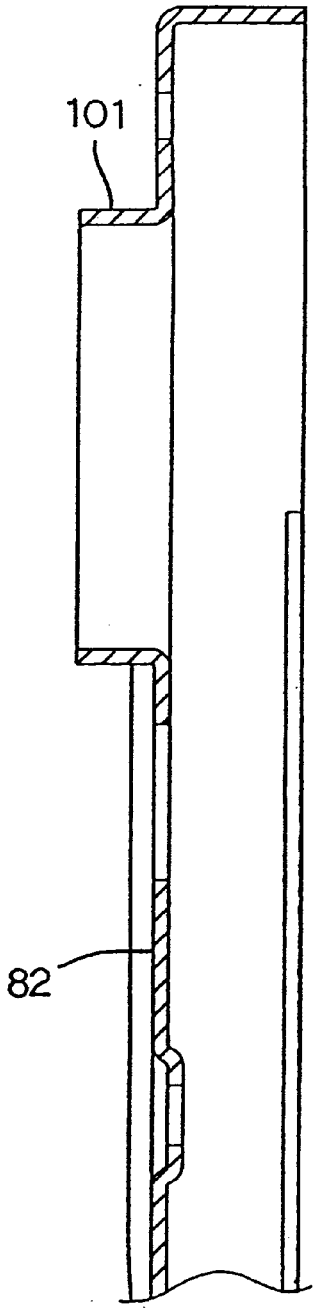
FIG. 5 is a side view in section showing a first cover of the operating lever of the chain lever hoist shown in FIG. 1.

A cylindrical insertion portion 101, projecting axially outwardly, for inserting the operating handle 59 therein is formed in the first cover 82, spaced apart from the outer periphery of the base 60 of the operating handle 59 with a predetermined interval, as shown in FIG. 5.

Now, the usage of the chain lever hoist thus constructed of the illustrated embodiment will be described.

First, a description will be given on the hoist of or the lowering of a load suspended from a lower hook (not shown)

provided at the end of the load chain 33 on the loaded side thereof (on which load is applied). When a load is hoisted up, the engaging pawl 80 is positioned at the normal position by the operation of the selector lever 86, first, and then the operating lever 81 is operated in reciprocation. Then, the first hub 55 is screwed forward along the drive shaft 37 by the drive from the operating lever 81 to press the first lining plate 40 of the mechanical brake 38. Thereby the drive shaft 37 is driven in the normal rotation direction through the second hub 39 coupled with the drive shaft 37 in such a manner as to be non-rotatable relative thereto. When the drive shaft 37 is driven, the drive is transmitted to the load sheave 34 through the reduction gear mechanism 67 and thereby the load sheave 34 is rotated in the direction for the load to be hoisted up. As a result of this, the load suspended from the lower hook provided at the end of the load chain 33 running over the load sheave 34 is hoisted up. The suspended load is kept in its hoisted position by the operation of the mechanical brake 38 or by the engagement of the anti-reverse pawl 46 with the anti-reverse gear 41.

When the load is lowered down, the engaging pawl 80 is positioned at the reverse position by the operation of the selector lever 86, first, and then the operating lever 81 is operated in reciprocation. Then, the first hub 55 is screwed backward along the drive shaft 37 by the drive from the operating lever 81 to release the pressing of the first hub 55 against the mechanical brake 38, so that the mechanical brake 38 is released. As a result of this, the drive shaft 37 is put into a freely rotatable state and thus is rotated in the reverse rotation direction under the weight of load, so that the load is lowered down. On the other hand, the reverse rotation of the drive shaft 37 causes the first hub 55 threadedly engaged with the drive shaft 37 to be screwed forward again along the drive shaft 37, to press the first lining plate 40. As a result of this, the mechanical brake 38 acts again to prevent the rotation of the drive shaft 37 in the reverse rotation direction. Thus, when the load is lowered down, the mechanical brake 38 is made active and inactive alternately so that the load sheave 34 can be allowed to rotate in the lowering direction little by little. The suspended load is lowered down in this manner.

Further, when the load chain 33 is desired to be adjusted in length at the start of working, for example, the engaging pawl 80 is switched to the neutral position by the operation of the selector lever 86 and then the load chain 33 on the non-loaded side thereof is pulled or the operating handle 59 is rotated in the reverse direction, to thereby produce the free rotation state just the way it is. In other words, in the state in which no load is applied to the load chain 33 and also the engagement between the engaging pawl 80 and the engaging teeth 56 is released, the pressing of the first hub 55 against the first lining plate 40 of the mechanical brake 38 is released by the spring force of the coil spring 92. As a result of this, the first hub 55 and the drive shaft 37 come into a state where they rotate together and thereby the free rotation occurs. If a load is applied to the load chain 33 on the loaded side thereof or a load is suspended from the lower hook, a large thrust from the weight of the load is applied to the drive shaft 37, so that even if the engaging pawl 80 is switched to the neutral position, the first hub 55 will press the first lining plate 40 of the mechanical brake 38 against the spring force of the coil spring 92, so the free rotation state will not be produced. Further, when the load chain 33 on the load side thereof is pulled in the free rotation state so suddenly that the rotation drive exceeding the contact resistance between the drive shaft and the first hub 55 is applied to the drive shaft 37, the mechanical brake 38 is put into action against the spring force of the coil spring 92. Thus, in this case also, the free rotation is released to ensure the safety.

According to the chain lever hoist of the illustrated embodiment, since the operating lever 81 is supported with a predetermined spaced interval from the first hub 55, the first hub 55 can be rotated together with the drive shaft 37 without contacting with the operating lever 81, thus ensuring smooth and reliable rotation of the first hub 55. By virtue of this, the condition for the relative rotation of the first hub 55 to the drive shaft 37 to be caused, in other words, the condition for the mechanical brake 38 to be put in action in the free rotation state, can be determined by only the spring force of the coil spring 92. Thus, it is good enough for attainment of the reliable free rotation operation to adopt the coil spring 92 having spring force to such an extent that can put the mechanical brake 38 into action when the rotation drive exceeding the contact resistance between the drive shaft and the first hub 55 is applied to the drive shaft 37 in the free rotation state. Thus, the stable free rotation operation can be ensured for a long term with the simple design.

According to the chain lever hoist of the illustrated embodiment, since the operating handle 59 is mounted on the first hub 55 in such a manner as to be non-rotatable relative thereto, the pressing of the first hub 55 against the mechanical brake 38 can be released simply by rotating the operating handle 59 in the reverse direction for the free rotation operation, thus attaining facilitated free rotation operation. Besides, since the operating handle 59 is mounted on the first hub 55 with a predetermined spaced interval from the cylindrical insertion portion 101 of the operating lever 81, the operating handle 59 can be prevented from contacting with the operating lever 81 during the free rotation operation, to ensure the smooth and reliable rotation.

Further, according to the chain lever hoist of the illustrated embodiment, since the first hub 55 and the second hub 39 are threadedly engaged with the screw-thread portion 50 of the drive shaft of substantially equal in diameter and also the axial movement of the second hub 39 threadedly engaged with the screw-thread portion 50 is limited by the stop member 54 fitted in the fitting groove 51, reliable free rotation operation can be ensured, while also rigidity of the drive shaft 37 can be increased. In other words, for example in a case where the drive shaft 37 is splined at a portion thereof for mounting the second hub 39 thereon and is threaded at a portion thereof for mounting the first hub 55, the drive shaft will inevitably be reduced in rigidity and durability. This is because since the second hub 39 must be mounted first prior to the mounting of the first hub 55 in the assembling work, the threaded portion of the drive shaft cannot help being made smaller in diameter than the splined portion and also a portion of the drive shaft extending between the splined portion and the threaded portion cannot help being made smaller in diameter than those portions for the machining need. The arrangement of the invention in which the first hub 55 and the second hub 39 are both threadedly mounted on the screw-thread portion 50 of substantially equal in diameter and also the stop member 54 is fitted in the fitting groove 51, so that the first hub 55 can be screwed forward and backward along the drive shaft 37 and also the second hub 39 can be non-rotatable relative to the drive shaft 37 can provide increased rigidity of the drive shaft 37 and thus improved durability of the chain lever hoist.

While the illustrative embodiments of the present invention is provided in the above description, such is for illustrative purpose only and it is not to be construed restrictively. Modification and variation of the present invention that will be obvious to those skilled in the art is to be covered in the following claims.

What is claimed is:

1. A chain lever hoist comprising:

a load sheave with which a load chain is engaged;

a first hub forming engaging teeth around an outside thereof;

an operating lever having an engaging pawl selectively engageable with the engaging teeth and loosely fitted around the outside of the first hub;

a mechanical brake comprising a second hub interposed between the first hub and the load sheave, an anti-reverse gear supported on the second hub, two brake disks supported on the second hub at the opposite sides of the anti-reverse gear, and an anti-reverse pawl disposed at the outside of the anti-reverse gear and engageable with the anti-reverse gear;

a reduction gear;

a drive shaft, on which the first hub is threadedly mounted and with which the second hub is connected in non-rotatable relation relative thereto and onto which the load sheave is fitted, for allowing drive applied from the operating lever to be transmitted to the load sheave through the reduction gear mechanism;

a biasing means, interposed between the first hub and the second hub for biasing the first hub and the second hub away from each other;

an operating member fitted onto the drive shaft and mounted on the first hub;

a brake cover for covering the mechanical brake, the brake cover having an opening for the first hub to be inserted therein;

wherein the operating lever is rotatably supported on the brake cover at the opening thereof with a predetermined spaced interval from the first hub;

wherein the operating member comprises a cylindrical base at a proximal end, an intermediate shoulder portion, and a cylindrical grip at a distal end, the base having a perimeter extending to the shoulder portion, and the base having a diameter smaller than a diameter of the cylindrical grip;

wherein the operating member is mounted on the first hub in non-rotatable relation relative thereto, and a horizontal cylindrical insertion portion to insert the operating member is formed in the operating lever with a first predetermined radial spaced interval between a circumference of the base and the horizontal cylindrical insertion portion;

wherein the shoulder portion is opposite a distal end of the cylindrical insertion portion at a second predetermined spaced interval and the cylindrical grip is positioned external to the cylindrical insertion portion;

wherein the biasing means has a biasing force sufficient to release the pressing of the first hub against the mechanical brake when no load is applied to the load chain on a loaded side, and when the engaging pawl does not engage with the engaging teeth, so as to enable the first hub and the drive shaft to rotate together and thereby maintain a free rotation condition; and wherein the biasing force is sufficient to engage the mechanical brake when a rotation drive exceeds the contact resistance between the drive shaft and the first hub.

2. A chain lever hoist according to claim 1, wherein the brake cover has a brake-cover-side connecting portion for connecting the brake cover with the operating lever, the operating lever has a lever-side connecting portion for connecting the operating lever with the brake cover, the brake-cover-side connecting portion and the lever-side connecting portion being connected together by connecting means, and wherein the connecting means is arranged with a predetermined spaced interval from the first hub.

3. A chain lever hoist according to claim 1, wherein the connecting means comprises a holding member for holding the brake-cover-side connecting portion and the lever-side connecting portion in sandwich relation and a retaining member which is held in sandwich relation together with the brake-cover-side connecting portion and the lever-side connecting portion.

* * * * *